US011134358B2

(12) United States Patent
Lin et al.

(10) Patent No.: US 11,134,358 B2
(45) Date of Patent: Sep. 28, 2021

(54) AUDIO ADJUSTING METHOD AND AUDIO ADJUSTING DEVICE

(71) Applicant: C-MEDIA ELECTRONICS INC., Taipei (TW)

(72) Inventors: Chin-Wei Lin, Taipei (TW); Ta-Chun Wang, Taipei (TW); Chi-Chen Cheng, Taipei (TW)

(73) Assignee: C-MEDIA ELECTRONICS INC., Taipei (TW)

( * ) Notice: Subject to any disclaimer, the term of this patent is extended or adjusted under 35 U.S.C. 154(b) by 0 days.

(21) Appl. No.: 16/987,406

(22) Filed: Aug. 7, 2020

(65) Prior Publication Data

US 2021/0120361 A1 Apr. 22, 2021

(30) Foreign Application Priority Data

Oct. 16, 2019 (TW) ..... 108137352

(51) Int. Cl.
*H04S 7/00* (2006.01)
*H04S 3/00* (2006.01)

(52) U.S. Cl.
CPC ..... *H04S 7/304* (2013.01); *H04S 3/008* (2013.01); *H04S 2400/01* (2013.01); *H04S 2400/11* (2013.01); *H04S 2400/13* (2013.01)

(58) Field of Classification Search
CPC .. H04S 2400/11; H04S 2400/01; H04S 3/008; H04S 2400/13; H04S 7/304
USPC ..... 381/303
See application file for complete search history.

(56) References Cited

U.S. PATENT DOCUMENTS 10,966,045 B2 * 3/2021 Osman ..... H04S 7/304

FOREIGN PATENT DOCUMENTS

CN 105163223 A 12/2015
CN 103218198 B 12/2016

* cited by examiner

*Primary Examiner* — Paul Kim
(74) *Attorney, Agent, or Firm* — Li & Cai Intellectual Property Office

(57) ABSTRACT

An audio adjusting method and an audio adjusting device are provided. The audio adjusting method includes the steps of: receiving a plurality of directional audio signals; calculating a displacement amount through a positioning module; calculating a plurality of gain values corresponding to the displacement amount through a processing module; adjusting volume levels of the plurality of directional audio signals according to the plurality of gain values; converting the plurality of directional audio signals into a two- or multi-channel audio signal according to the quantity of two or more channels of a head-mounted playback device; and playing the two-channel or multi-channel audio signal through the head-mounted playback device.

17 Claims, 4 Drawing Sheets

AUDIO ADJUSTING METHOD AND AUDIO ADJUSTING DEVICE

CROSS-REFERENCE TO RELATED PATENT APPLICATION

This application claims the benefit of priority to Taiwan Patent Application No. 108137352, filed on Oct. 16, 2019. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an audio adjusting device and an audio adjusting method, and more particularly to an audio adjusting device and an audio adjusting method that can offer better user experience.

BACKGROUND OF THE DISCLOSURE

At present, a user mainly uses images and audio data for determining orientation in various scenes when playing a first-person game or watching a video. However, an image can only show the field of view presently in front of the user. The user may perform a scene analysis according to a scene in the field of view and audio data. For example, the user can determine that a person is approaching from left, a car is coming from front, or the like according to the scene in the field of view. However, sometimes, in some scenes in a game or video, there may be a sound source beyond the field of view of the user. For example, when a car comes from behind, a person appears far away, or an animal sneaks by, the user may also determine from the faint sound to know what to do next or how the story unfolds. However, the user often needs to change a direction or adjust a camera direction to accurately learn about such a sound source or faint sound beyond the field of view.

However, when the user needs to focus on content in front of the eyes for a longer period time, it would be exhausting for the user to accurately determine these sound sources or faint sounds beyond the field of view.

When a sound source is beyond the field of view of the user or is relatively faint, the user needs to control a game character to turn around or move toward the sound to learn more about the sound source. However, the game character may be exposed to danger as a result. Moreover, a film is not interactive, and it is therefore impossible for the user to learn more about the content of the sound by controlling the game character to the user's satisfaction. When playing a game or watching a film, the user will enjoy better interactive experience in the game or film if the user does not need to change the direction or position of the game character and can learn about audio data in all directions of the game or film simply by performing habitual movements in a way the user behaves in reality, e.g., tilting the head and listening attentively.

When a playback system is a multi-channel speaker, as the user moves or turns the head in a direction, the sound from speakers in said direction and nearby directions becomes louder, and the sound from a speaker in an opposite direction becomes lower. In this way, the effect of "tilting the head and listening attentively" is achieved. This effect is more noticeable when a movement distance is larger. However, a head-mounted playback system such as head-mounted headphones, a headset, and in-ear headphones cannot achieve the same effect.

Therefore, it becomes an important subject in the industry to provide an audio adjusting device and an audio adjusting method that enable a user to accurately learn about audio data in all directions in a game or film merely with a slight gesture.

A positioning module is used in the present disclosure to detect an amount of displacement, that is, the direction and distance of a movement of the head of a user, to adjust an audio content, so that a head-mounted playback system can also achieve the effect of "tilting the head and listening attentively", thereby resolving the foregoing problem.

SUMMARY OF THE DISCLOSURE

In response to the above-referenced technical inadequacies, the present disclosure provides an audio adjusting method and audio adjusting device.

In one aspect, the present disclosure provides an audio adjusting method, including the steps of: receiving a plurality of directional audio signals; calculating a displacement amount through a positioning module; calculating a plurality of gain values corresponding to the displacement amount through a processing module; adjusting volume levels of the plurality of directional audio signals according to the plurality of gain values; converting the plurality of directional audio signals into a two- or multi-channel audio signal that matches the quantity of two or more channels of a head-mounted playback device; and playing the audio signal through the head-mounted playback device.

In another aspect, the present disclosure provides an audio adjusting device. The audio adjusting device includes a receiving module, a positioning module, a processing module, a volume adjusting module, and a channel conversion module. The receiving module is configured to receive a plurality of directional audio signals. The positioning module is configured to calculate a displacement amount. The processing module is electrically connected to the receiving module and the positioning module, and includes a gain calculation unit that is configured to calculate gain values corresponding to the plurality of directional audio signals according to the displacement amount. The volume adjusting module is electrically connected to the processing module, and is configured to adjust volume levels of the plurality of directional audio signals according to the gain values calculated by the gain calculation unit of the processing module. The channel conversion module is electrically connected to the volume adjusting module, and is configured to convert the plurality of directional audio signals with adjusted volume into a two- or multi-channel audio signal that matches the quantity of two or more channels of a head-mounted playback device.

The audio adjusting device in the present disclosure adjusts volume levels of different directional audio signals according to a displacement amount calculated by the positioning module, so that a user may move the head to increase volume in a specific direction to further identify an audio content. Therefore, the interactive audio experience offered to a user can be effectively improved.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
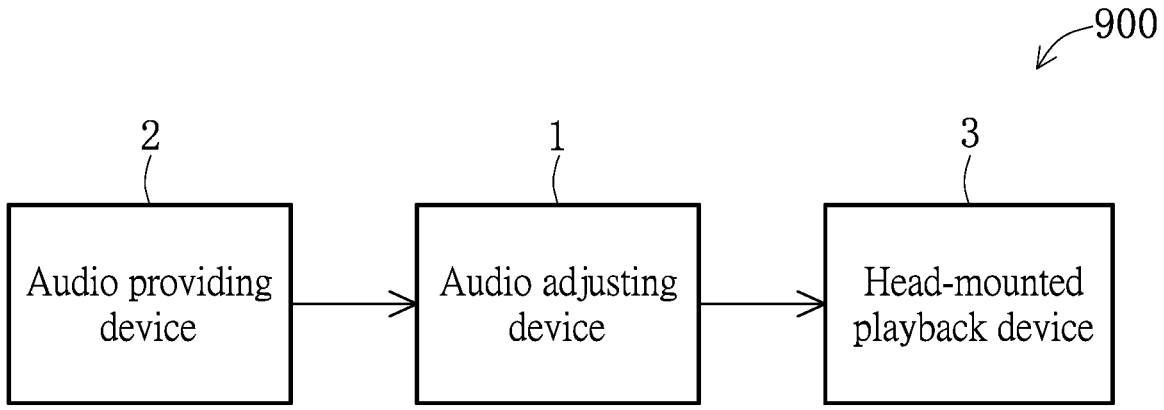
FIG. 1 is a block diagram of an audio adjusting system according to an embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
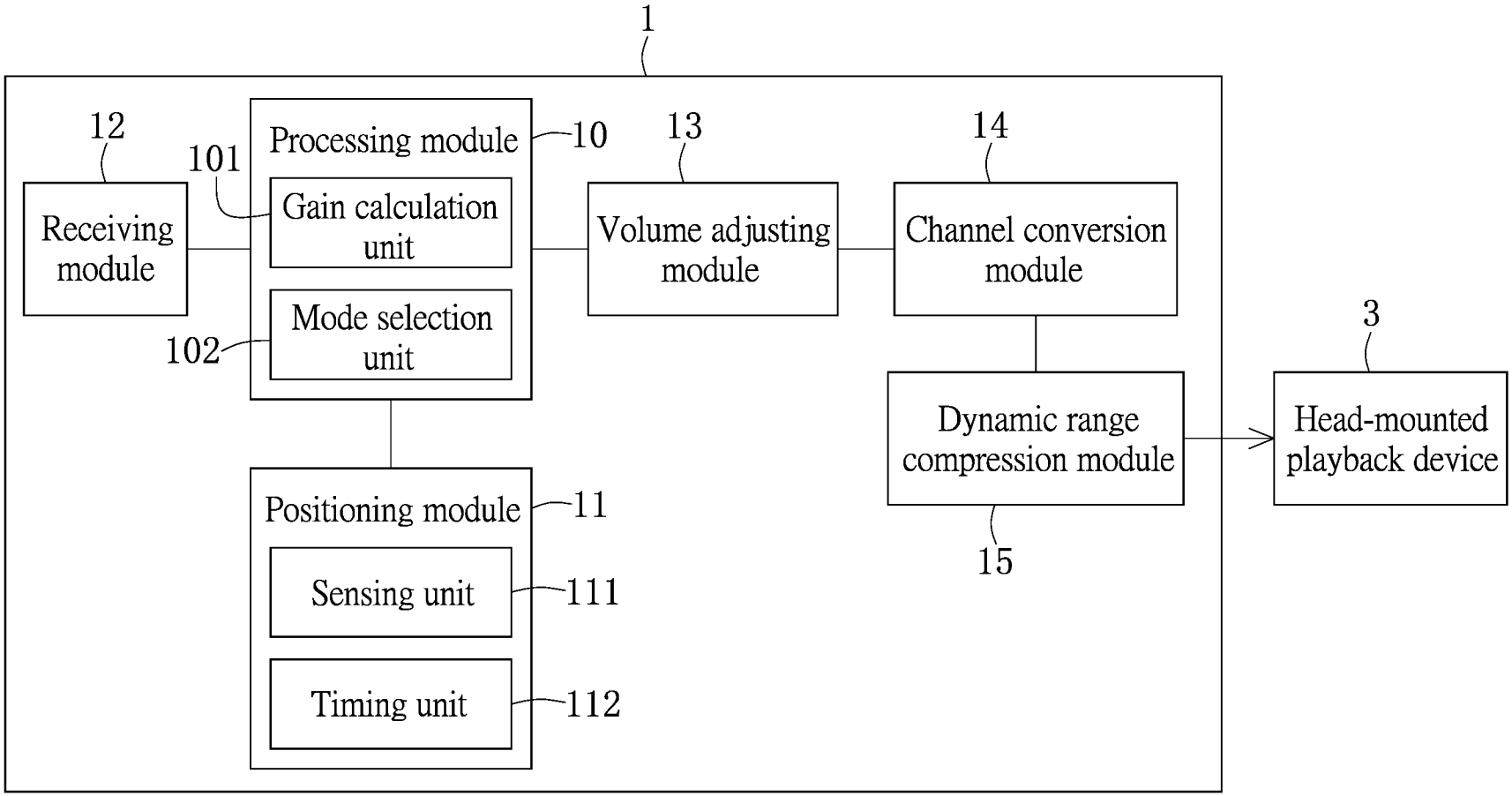
FIG. 2 is a block diagram of an audio adjusting device according to an embodiment of the present disclosure.

Refer to FIG. 1 and FIG. 2. FIG. 1 is a block diagram of an audio adjusting system according to an embodiment of the present disclosure. FIG. 2 is a block diagram of an audio adjusting device according to an embodiment of the present disclosure.

In this embodiment, an audio adjusting system 900 includes an audio adjusting device 1, an audio providing device 2, and a head-mounted playback device 3.

In this embodiment, the audio providing device 2 is communicatively connected to the audio adjusting device 1. The audio adjusting device 2 is communicatively connected to the head-mounted playback device 3. That is, the audio providing device 2 may provide a plurality of audio signals to the audio adjusting device 1 in a wired communication manner or a wireless communication manner. The audio adjusting device 1 may provide a plurality of audio signals to the head-mounted playback device 3 in a wired communication manner or wireless communication manner.

In this embodiment, the audio providing device 2 may be a computer system, a tablet computer, a mobile phone, a wearable device, an augmented reality (AR) device, or a virtual reality (VR) device, and may be adjusted or designed according to actual requirements. This is not limited in the present disclosure.

The head-mounted playback device 3 may be a wired or wireless headphone device, and may be a head-mounted model, an in-ear model, or the like, and may be adjusted or designed according to actual requirements. This is not limited in the present disclosure.

The audio adjusting device 1 receives a plurality of directional audio signals from the audio providing device 2. The plurality of directional audio signals provided by the audio providing device 2 are an audio content provided according to a listening reference position in a listening environment. For example, when the audio providing device 2 is a VR device, the audio providing device 2 provides directional audio signals without adjusted gain values in a surrounding environment (a listening scene) according to the position (the listening reference position) of a user. When walking to different positions in the scene, the user may hear directional audio signals without adjusted gain values at the different positions.

The audio adjusting device 1 includes a processing module 10, a positioning module 11, a receiving module 12, a volume adjusting module 13, a channel conversion module 14, and a dynamic range compression module 15.

The receiving module 12 is configured to receive the plurality of directional audio signals. The positioning module 11 is configured to calculate a displacement amount. The processing module 10 is electrically connected to the receiving module 12 and the positioning module 11. The positioning module 11 provides the displacement amount to the processing module 10.

In this embodiment, the processing module 10 includes a gain calculation unit 101 and a mode selection unit 102.

In this embodiment, the gain calculation unit 101 is configured to calculate gain values corresponding to the plurality of directional audio signals according to the displacement amount provided by the positioning module 11.

In this embodiment, the mode selection unit 102 is configured to select one of a plurality of gain adjustment modes according to a mode selection signal.

The volume adjusting module 13 is electrically connected to the processing module 10. The volume adjusting module 13 correspondingly adjusts volume levels of the plurality of directional audio signals according to the gain values of the plurality of directional audio signals provided by the gain calculation unit 101 of the processing module 10.

The channel conversion module 14 is electrically connected to the volume adjusting module 13, and is configured to convert the plurality of directional audio signals with adjusted volume into a playback audio signal. In this embodiment, the playback audio signal is an audio signal that matches a quantity of channels disposed on the head-mounted playback device 3. That is, the head-mounted playback device 3 may be provided with a two-channel playback module or a multi-channel playback module. The channel conversion module 14 provides, according to the quantity of channels of the head-mounted playback device 3, a playback audio signal of the same quantity of channels.

The dynamic range compression module 15 is electrically connected to the channel conversion module 14, and is configured to determine whether a volume value of the playback audio signal is greater than a critical value, to determine whether to perform volume compression. If the volume value of the playback audio signal is greater than the critical value, volume compression is performed on the playback audio signal. In this embodiment, a method of performing proportional compression on the waveform of the playback audio signal is used to enable the volume value of the playback audio signal to be less than the critical value.

In this embodiment, the playback audio signal is played through the head-mounted playback device 3.

The positioning module 11 may be a joystick device, a key device, a touch device, or a position sensing device, and may be adjusted or designed according to actual requirements. This is not limited in the present disclosure.

In this embodiment, the positioning module 11 includes a sensing unit 111 and a timing unit 112. The sensing unit 111 of the positioning module 11 is configured to detect whether a movement change amount of the positioning module 11 within a predetermined time exceeds a predetermined distance, to determine a positioning point. The timing unit 112 is configured to detect the predetermined time.

In this embodiment, the sensing unit 111 may be a three-dimensional acceleration sensor, a gyroscope sensor or any sensor that can detect the movement of a head, e.g., a camera sensor, an infrared sensor, or an ultrasonic sensor, and may be adjusted or designed according to actual requirements. This is not limited in the present disclosure.

In addition, in this embodiment, the mode selection unit 102 includes a plurality of gain adjustment modes, where the plurality of gain adjustment modes include a first mode and a second mode.

In the first mode, the gain calculation unit 101 calculates the gain values of the plurality of directional audio signals according only to the displacement amount calculated by the positioning module 11.

In the second mode, in addition to calculating the gain values of the plurality of directional audio signals according to the displacement amount calculated by the positioning module 11. The gain calculation unit 101 further analyzes whether each directional audio signal includes contents such as a gunshot or a voice that concerns the user to determine whether to increase a gain value. That is, in the second mode, a specific audio content signal in the plurality of directional audio signals is analyzed and chosen, and a gain value is then adjusted. That is, in the second mode, the gain calculation unit 101 calculates the gain values of the plurality of directional audio signals and a gain value of the specific audio content signal in the plurality of directional audio signals according to the displacement amount calculated by the positioning module 11.

In this embodiment, the gain values corresponding to the plurality of directional audio signals are respectively inversely proportional to respective distance values of the plurality of direction audio signals. That is, a sound from a farther position is lower. When the user is located at any position in the listening scene, the user may hear a plurality of directional audio signals without adjusted gain values in a surrounding environment of the position, and the user needs only slightly tilt the head to obtain the foregoing displacement amount, so that the user may hear the plurality of directional audio signals with adjusted gain values. That is, at any listening reference position in the listening scene, the user can hear the audio content of the plurality of directional audio signals without adjusted gain values originally provided by the audio providing device 2. In addition, the user does not need to adjust the listening reference position in the listening scene at all, but needs only slightly tilt the head, incline the body or use a joystick to obtain a displacement amount to hear directional audio signals with adjusted gain values, so as to further clearly recognize the audio content of the directional audio signals in the listening scene. In this embodiment, the user needs only make a body gesture to obtain the foregoing displacement amount. The body gesture of the user includes tilting the head, inclining the body, tapping, pressing, moving or turning the body, moving or turning the head, and the like. Further, in combination with the design of the positioning module 11, the user can clearly discern the audio content of the plurality of directional audio signals in the surrounding environment without moving in the listening scene.

In another embodiment, the gain values corresponding to the plurality of direction signals are respectively inversely proportional to the squares of respective distance values of the plurality of directional audio signals. That is, a sound from a farther position is lower than a sound from a nearby position, and has a volume even lower than a volume that is inversely proportional to a distance value.

Second Embodiment

Figure 3:
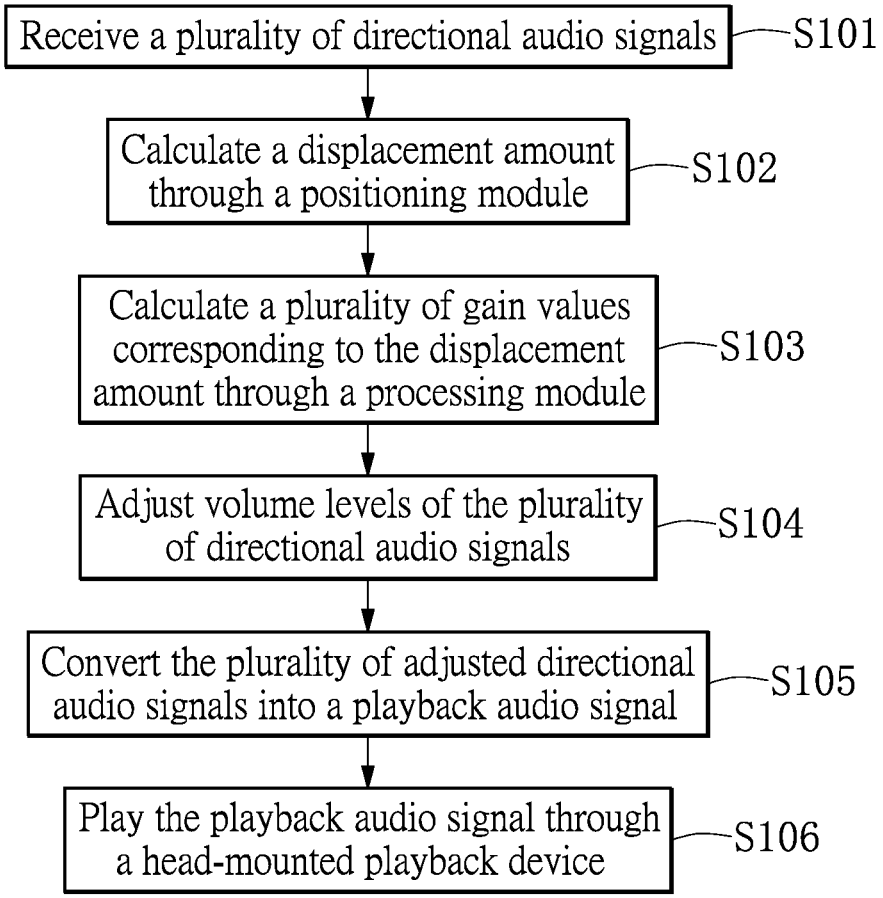
FIG. 3 is a flowchart of an audio adjusting method according to an embodiment of the present disclosure.
Figure 4:
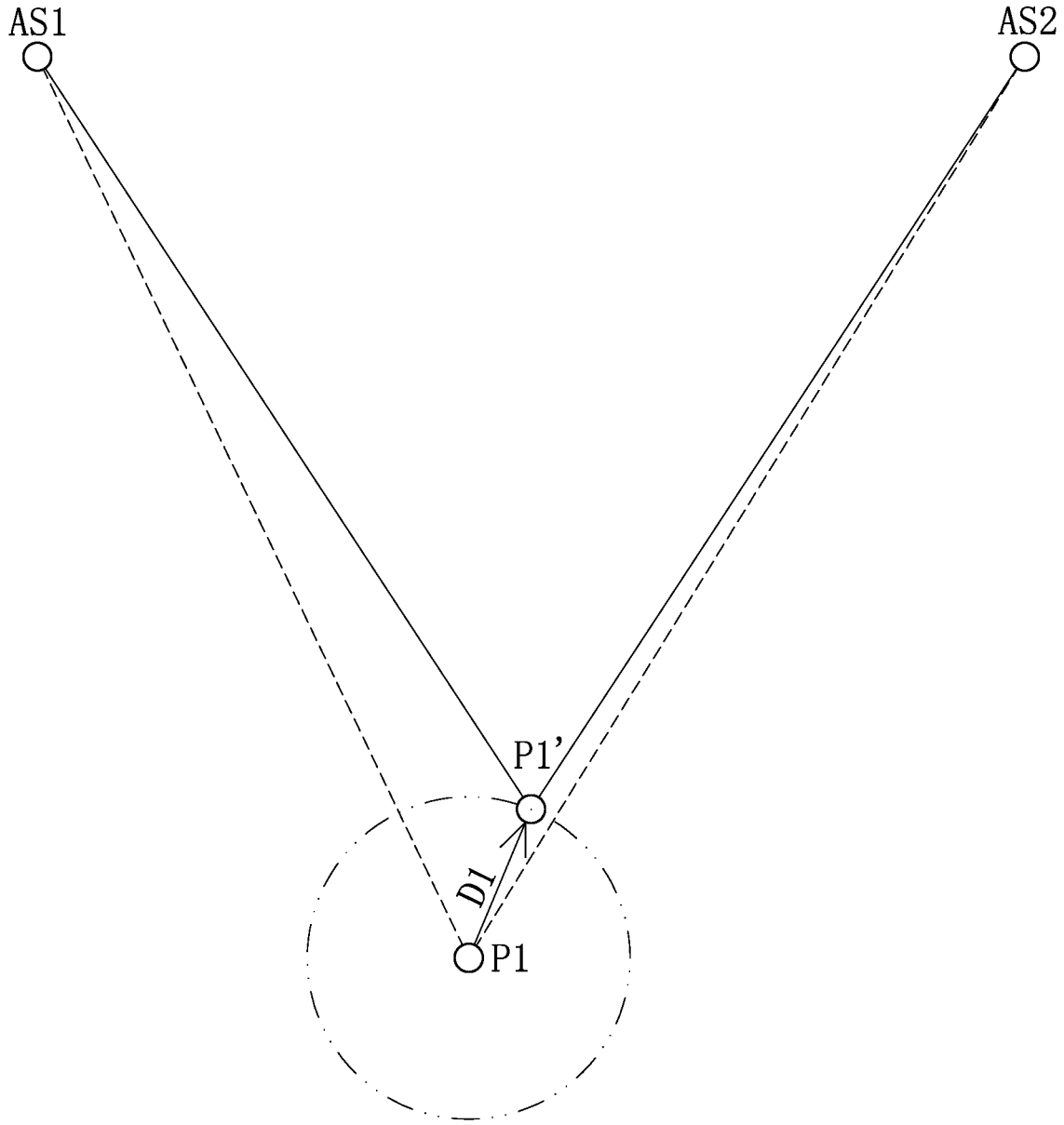
FIG. 4 is a schematic diagram of a user recognizing a first directional audio signal and a second directional audio signal by using an audio adjusting method according to an embodiment of the present disclosure.

Refer to FIG. 3 and FIG. 4. FIG. 3 is a flowchart of an audio adjusting method according to an embodiment of the present disclosure. FIG. 4 is a schematic diagram of a user recognizing a first directional audio signal and a second directional audio signal by using an audio adjusting method according to an embodiment of the present disclosure.

In this embodiment, an audio adjusting method is provided and is applicable to the foregoing audio adjusting system 900. In this embodiment, the structure and function of the audio adjusting system 900 are the same as those in the foregoing embodiment. Details thereof are not described again herein.

The audio adjusting method in this embodiment includes the steps of:

receiving a plurality of directional audio signals (step S101);

calculating a displacement amount through a positioning module (step S102);

calculating a plurality of gain values corresponding to the displacement amount through a processing module (step S103);

adjusting volume levels of the plurality of directional audio signals (step S104);

converting the plurality of directional audio signals into a playback audio signal (step S105); and playing the playback audio signal through a head-mounted playback device (step S106).

In addition, in step S104, the audio adjusting method further includes the steps of:

selecting one of a plurality of gain modes, and adjusting the volume levels of the directional audio signals according to the plurality of gain values and the one of the plurality of gain modes.

In step S101, the audio adjusting device 1 is communicatively connected to the audio providing device 2 to receive the plurality of directional audio signals provided by the audio providing device 2.

In step S102, the positioning module 11 first calculates a displacement amount. The displacement amount is determined according to a distance by which the positioning module 11 moves.

In this embodiment, the head-mounted playback device 3 is head-mounted headphones. The audio adjusting device 1 is disposed on the head-mounted playback device 3. The user may move the head, that is, move the head-mounted playback device 3 (the head-mounted headphones) to enable the positioning module 11 of the audio adjusting device 1 to generate a displacement amount D1. For example, the positioning module 11 records a starting point (a positioning point P1) and an end point of the displacement amount D1 to determine the direction and distance of the displacement amount D1. After the displacement amount D1 is calculated, the positioning module 11 provides the displacement amount D1 to the processing module 10. In this embodiment, the positioning point P1 may be adjusted or designed according to actual requirements. This is not limited in the present disclosure.

In this embodiment, the positioning module 11 includes a sensing unit 111 and a timing unit 112. The sensing unit 111 of the positioning module 11 is configured to detect a displacement amount of the positioning module 11. The timing unit 112 is configured to detect a predetermined time. In this embodiment, the predetermined time may be adjusted or designed according to actual requirements. This is not limited in the present disclosure.

In this embodiment, the positioning module 11 may be a joystick device, a key device, a touch device, or a position sensing device, and may be adjusted or designed according to actual requirements. This is not limited in the present disclosure.

In step S103 and step S104, the gain calculation unit 101 of the processing module 10 calculates the gain values corresponding to the plurality of directional audio signals according to the displacement amount provided by the positioning module 11. In this embodiment, a first directional audio signal AS1 and a second directional audio signal AS2 are audio signals that can be received by the positioning point P1. The user may make a slight movement to move to a positioning point P1' to generate the displacement amount D1. The audio adjusting device 2 in this embodiment of the present disclosure adjusts gain values of the first directional audio signal AS1 and the second directional audio signal AS2 to adjust volume levels, so as to further recognize the audio content of the first directional audio signal AS1 and the second directional audio signal AS2.

The volume adjusting module 13 correspondingly adjusts the volume levels of the plurality of directional audio signals according to a plurality of gain values of the gain calculation unit 101 of the processing module 10.

In this embodiment, the gain values of the plurality of directional audio signals are respectively inversely proportional to respective distance values of the plurality of directional audio signals. That is, a sound from a farther position is lower.

In another embodiment, the gain values of the plurality of directional audio signals are respectively inversely proportional to the squares of respective distance values. That is, a sound from a farther position is lower than a sound from a nearby position, and has volume even lower than volume that is inversely proportional to a distance value.

In addition, in step S104, the volume adjusting module 13 may further adjust the volume levels of the plurality of directional audio signals according to a gain adjustment mode selected by the mode selection unit 102. That is, the volume adjusting module 13 may adjust the volume levels of the directional audio signals only according to a plurality of gain values calculated by the gain calculation unit 101 or may adjust the volume levels of the plurality of directional audio signals according to a plurality of gain values calculated by the gain calculation unit 101 and the gain adjustment mode selected by the mode selection unit 102.

In this embodiment, the mode selection unit 102 is configured to select one of a plurality of gain adjustment modes according to a mode selection signal.

The mode selection unit 102 includes a plurality of gain adjustment modes, where the plurality of gain adjustment modes include a first mode and a second mode.

In the first mode, the gain calculation unit 101 adjusts the volume levels of the directional audio signals according to a plurality of gain values. That is, volume adjustment is performed on audio signals around the positioning point.

In the second mode, in addition to calculating the gain values of the plurality of directional audio signals according to the displacement amount calculated by the positioning module 11, the gain calculation unit 101 further analyzes whether each directional audio signal includes contents such as a gunshot or a voice that concerns the user to determine whether to increase a gain value. That is, in the second mode, a specific audio content signal in the plurality of directional audio signals is analyzed and chosen, and a gain value is then adjusted. That is, in the second mode, the gain calculation unit 101 calculates the gain values of the plurality of directional audio signals and a gain value of the specific audio content signal in the plurality of directional audio signals according to the displacement amount calculated by the positioning module 11.

The positioning module 11 may be a joystick device, a key device, a touch device, or a position sensing device, and may be adjusted or designed according to actual requirements. This is not limited in the present disclosure.

In this embodiment, the positioning module 11 includes a sensing unit 111 and a timing unit 112. The sensing unit 111 of the positioning module 11 is configured to detect whether a movement change amount of the positioning module 11 within a predetermined time exceeds a predetermined distance, to determine a positioning point. The timing unit 112 is configured to detect the predetermined time. In this embodiment, the predetermined time may be adjusted or designed according to actual requirements. This is not limited in the present disclosure.

In this embodiment, the sensing unit 111 may be a three-dimensional acceleration sensor, a gyroscope sensor or any sensor that can detect the movement of a head (e.g., a camera sensor, an infrared sensor, or an ultrasonic sensor), and may be adjusted or designed according to actual requirements. This is not limited in the present disclosure.

In step S105 and step S106, the channel conversion module 14 is configured to convert the plurality of directional audio signals with adjusted volume into a playback audio signal. In this embodiment, the playback audio signal is an audio signal that matches a quantity of channels disposed on the head-mounted playback device 3. That is, the head-mounted playback device 3 may be provided with a two-channel playback module or a multi-channel playback module. The channel conversion module 14 provides, according to the quantity of channels of the head-mounted playback device 3, a playback audio signal of the same quantity of channels. The dynamic range compression module 15 is electrically connected to the channel conversion module 14, and is configured to determine whether a volume value of the playback audio signal is greater than a critical value, to determine whether to perform volume compression. If the volume value of the playback audio signal is greater than the critical value, volume compression is performed on the playback audio signal. In this embodiment, a method of performing proportional compression on the waveform of the playback audio signal is used to enable the volume value of the playback audio signal to be less than the critical value.

Finally, the superimposed audio signal is played through the head-mounted playback device 3.

The audio adjusting device 1 receives a plurality of directional audio signals from the audio providing device 2. The plurality of directional audio signals provided by the audio providing device 2 are an audio content provided according to a listening reference position in a listening environment. For example, when the audio providing device 2 is a VR device, the audio providing device 2 provides the audio content of directional audio signals without adjusted gain values in a surrounding environment (a listening scene) according to the position (the listening reference position) of a user. When walking to different positions in the scene, the user may hear the audio content of directional audio signals without adjusted gain values at the different positions.

In this embodiment, when the user is located at any position in the listening scene, the user may hear a plurality of directional audio signals without adjusted gain values in a surrounding environment of the position, and in addition, the user only needs to slightly tilt the head to further obtain the foregoing displacement amount, to hear the plurality of directional audio signals with adjusted gain values. That is, at any listening reference position in the listening scene, the user can hear the audio content of the plurality of directional audio signals without adjusted gain values originally provided by the audio providing device 2. In addition, the user does not need to adjust the listening reference position in the listening scene at all, but only needs to slightly tilt the head, incline the body, or use a joystick to obtain a displacement amount to hear the directional audio signals with adjusted gain values, so as to further clearly recognize the audio content of the directional audio signals in the listening scene. In addition, in this embodiment, the user only needs to make a body gesture to obtain the foregoing displacement amount. The body gesture of the user includes tilting the head, inclining the body, tapping, pressing, moving or turning the body, moving or turning the head, and the like. Further, in combination with the design of the positioning module 11, the user can clearly discern the audio content of the plurality of directional audio signals in the surrounding environment without moving in the listening scene.

BENEFICIAL EFFECTS OF EMBODIMENTS

In the present disclosure, the audio adjusting device generates a displacement amount to adjust volume levels of different directional audio signals, so that the user may further recognize the audio content through the audio adjusting device. Therefore, interactive audio experience of a user can be effectively improved.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An audio adjusting method, comprising steps of:

receiving a plurality of directional audio signals;

calculating a displacement amount through a positioning module;

calculating a plurality of gain values corresponding to the displacement amount through a processing module;

adjusting volume levels of the plurality of directional audio signals according to the plurality of gain values;

converting the plurality of directional audio signals into a playback audio signal; and playing the playback audio signal through a head-mounted playback device;

wherein a user wears the head-mounted playback device at a listening reference position in a listening scene, the head-mounted playback device receives the playback audio signal, and the user obtains the displacement amount without leaving the listening reference position in the listening scene; and wherein the user uses a body gesture to obtain the displacement amount without leaving the listening reference position in the listening scene.

2. The audio adjusting method according to claim 1, wherein the step of adjusting the volume levels according to the plurality of gain values further comprises the step of:

selecting one of a plurality of gain modes, and adjusting the volume levels of the directional audio signals according to the plurality of gain values and the one of the plurality of gain modes.

3. The audio adjusting method according to claim 1, wherein the positioning module includes a sensor, and the sensor is configured to detect the displacement amount.

4. The audio adjusting method according to claim 1, wherein the plurality of gain adjustment modes include a first mode, and in the first mode, the magnitude of each directional audio signal is respectively adjusted according to the plurality of gain values.

5. The audio adjusting method according to claim 1, wherein the plurality of gain adjustment modes include a second mode, and in the second mode, the gain values of the plurality of directional audio signals and a gain value of at least one specific audio content signal of the plurality of directional audio signals are calculated according to the displacement amount of the positioning module.

6. The audio adjusting method according to claim 1, wherein in the step of calculating gain values, the gain values corresponding to the plurality of direction signals are respectively inversely proportional to respective distance values of the plurality of direction signals.

7. The audio adjusting method according to claim 1, wherein in the step of calculating gain values, the gain values corresponding to the plurality of direction signals are respectively inversely proportional to squares of respective distance values of the plurality of direction signals.

8. An audio adjusting device, comprising:

a receiving module, configured to receive a plurality of directional audio signals;

a positioning module, configured to calculate a displacement amount;

a processing module, electrically connected to the receiving module and the positioning module, including:

a gain calculation unit, configured to calculate gain values corresponding to the plurality of directional audio signals according to the displacement amount;

a volume adjusting module, electrically connected to the processing module, and configured to adjust volume levels of the plurality of directional audio signals according to the plurality of gain values calculated by the gain calculation unit of the processing module; and a channel conversion module, electrically connected to the volume adjusting module, and configured to convert the plurality of directional audio signals with adjusted volume into a playback audio signal;

wherein a user wears a head-mounted playback device at a listening reference position in a listening scene, the head-mounted playback device receives the playback audio signal, and the user obtains the displacement amount without leaving the listening reference position in the listening scene; and wherein the user uses a body gesture to obtain the displacement amount without leaving the listening reference position in the listening scene.

9. The audio adjusting device according to claim 8, further comprising:

a dynamic range compression module, electrically connected to the channel conversion module, and configured to determine whether a volume value of an audio signal is greater than a critical value, to determine whether to perform volume compression.

10. The audio adjusting device according to claim 9, wherein the audio signal is played through a head-mounted playback device.

11. The audio adjusting device according to claim 10, wherein the positioning module includes:

a sensing unit, configured to detect the displacement amount.

12. The audio adjusting device according to claim 9, wherein the audio adjusting device is connected to an audio providing device and the head-mounted playback device, and wherein the plurality of directional audio signals are provided by the audio providing device.

13. The audio adjusting device according to claim 11, wherein the processing module further includes:

a mode selection unit, configured to select one of a plurality of gain adjustment modes according to a mode selection signal.

14. The audio adjusting device according to claim 12, wherein the plurality of gain adjustment modes include a first mode, and in the first mode, the magnitude of each directional audio signal is respectively adjusted according to the plurality of gain values.

15. The audio adjusting device according to claim 13, wherein the plurality of gain adjustment modes include a second mode, and in the second mode, the gain values of the plurality of directional audio signals and a gain value of at least one specific audio content signal of the plurality of directional audio signals are calculated according to the displacement amount of the positioning module.

16. The audio adjusting device according to claim 14, wherein the gain values corresponding to the plurality of direction signals are respectively inversely proportional to respective distance values of the plurality of direction signals.

17. The audio adjusting device according to claim 15, wherein the gain values corresponding to the plurality of direction signals are respectively inversely proportional to squares of respective distance values of the plurality of direction signals.

* * * * *